US005419718A

United States Patent [19]

Milburn et al.

[11] Patent Number: 5,419,718

[45] Date of Patent: May 30, 1995

[54] MIXED COAXIAL CONNECTOR

[75] Inventors: Paul Milburn, Scotland; Christopher Kaminski, Buckland Brewer, both of England

[73] Assignee: The Whitaker Corporation, Wilmington, Del.

[21] Appl. No.: 114,269

[22] Filed: Aug. 30, 1993

[30] Foreign Application Priority Data

Sep. 2, 1992 [GB] United Kingdom ..... 9218583
Nov. 5, 1992 [GB] United Kingdom ..... 9223241

[51] Int. Cl.[6] ..... H01R 17/04

[52] U.S. Cl. ..... 439/578; 439/394; 439/719

[58] Field of Search ..... 439/409–413, 439/417–419, 394, 578–585, 719

[56] References Cited

U.S. PATENT DOCUMENTS 4,173,386 11/1979 Kauffman et al. ..... 439/582
4,416,501 11/1983 Fusselman et al. ..... 439/394
4,632,486 12/1986 Hasircoglu .
4,697,862 10/1987 Hasircoglu ..... 439/394
4,701,001 10/1987 Verhoeven .
4,790,775 12/1988 David .
5,154,632 10/1992 Ijiri ..... 439/394

FOREIGN PATENT DOCUMENTS 2936616 3/1981 Germany ..... 439/394

OTHER PUBLICATIONS

Brochure from Molex Incorporated. Pp. 3, 5, and 6. "Product Presentation". More than one year prior to filing application.

*Primary Examiner*—David L. Pirlot
*Attorney, Agent, or Firm*—Mary K. Van Atten; Eric J. Groen

[57] ABSTRACT

An electrical connector is shown for terminating both signal and coaxial cable. To maintain the same interface pattern, the signal pins for the coaxial cable include contact portions with angled connection sections and ground contacts for contacting the shielding braid of a cable are laterally offset. The housing includes channels to arrange the coaxial cables with the signal contact termination portions and with the ground contact termination portions.

19 Claims, 11 Drawing Sheets

MIXED COAXIAL CONNECTOR

BACKGROUND OF THE INVENTION

1. Field of the Invention

The invention relates to an electrical connector including coaxial and signal contacts.

2. Description of the Prior Art

In the field of coaxial connectors, a solid core wire typically is positioned concentrically of a first portion of surrounding insulation, a shielding braid surrounding the first portion of insulation, and a second portion of insulation surrounding the shielding braid. Normally, such a cable is terminated by stripping a portion of the outer insulation to a position exposing a length of the shielding braid. The inner insulation is then stripped to expose a portion of the inner conductor. The shielding braid can be interconnected to an outer shield member by a crimp section, by a compression fit outer shield housing, or by soldering the shielding braid to the outer shield member. This interconnection is quite labor intensive and time consuming, and thus very expensive to make. Furthermore, it typically requires the assembly under controlled circumstances, not in a field installation.

It is also necessary, in some circumstances to provide such an interconnection for signal conductors and coaxial cable on a centerline spacing which is already a standardized interface. However, this difficult, as the width of the coaxial cable alone, does not allow such a pitch.

SUMMARY OF THE INVENTION

It is an object of the invention then to provide an electrical connector which can easily terminate, a coaxial wire thereto.

It is a further object of the invention to provide an electrical ground terminal which can be mass terminable to interconnect the ground terminal to the shielding braid of a coaxial connector.

To terminate the coaxial contacts in such an array, the coaxial nature of the cable must be maintained along its length as long as possible. This is provided by having a ground contact having insulation severing portions which extend upwardly from the position adjacent to the middle row up to a position aligned with the upper row contacts, such that when the coaxial cable is terminated downwardly the signal conductor is connected to the coaxial signal pin and the shielded coaxial braid is terminated to the ground pin.

The objects of the invention were accomplished by providing an electrical connector for the electrical connection to a coaxial cable, the connector comprising signal contacts for electrical connection to the coaxial signal conductor of a coaxial cable, and a shielding contact for the interconnection to a shielding braid of the coaxial cable. The connector is characterized in that the shielding contact includes insulation piercing means profiled to pierce through the insulation of the coaxial cable to make contact with the shielding braid.

It is a further object of the invention to provide an electrical connector which can terminate coaxial and standard signal contacts therein, positioned in an array for mating with a complementary connector.

Preferably, this connector can provide coaxial signal contacts and coaxial ground contacts in an array which is profiled as a standard connector configuration. Some of the pins in a top row and some of the pins in a middle row are connected to the coaxial cable where the top pins are provided as the signal contacts and the middle row contacts are provided as the ground contacts.

This further object of the invention is accomplished by providing an electrical connector for the electrical connection to signal and coaxial cables, the connector comprising first signal pins for electrical connection to the signal cable, and second signal contacts for electrical connection to the coaxial signal conductor. The connector is characterized in that the second signal pins for the coaxial signal conductor include contact portions having angled connection sections, and ground contacts for contacting the shielding braid of a cable, where the ground contacts are laterally offset from the contact portions.

BRIEF DESCRIPTION OF THE DRAWINGS

FIG. 23 shows the assembly of the stuffer cap in the connector housing without the cables in place.

DETAILED DESCRIPTION OF THE PREFERRED EMBODIMENT

Figure 1:
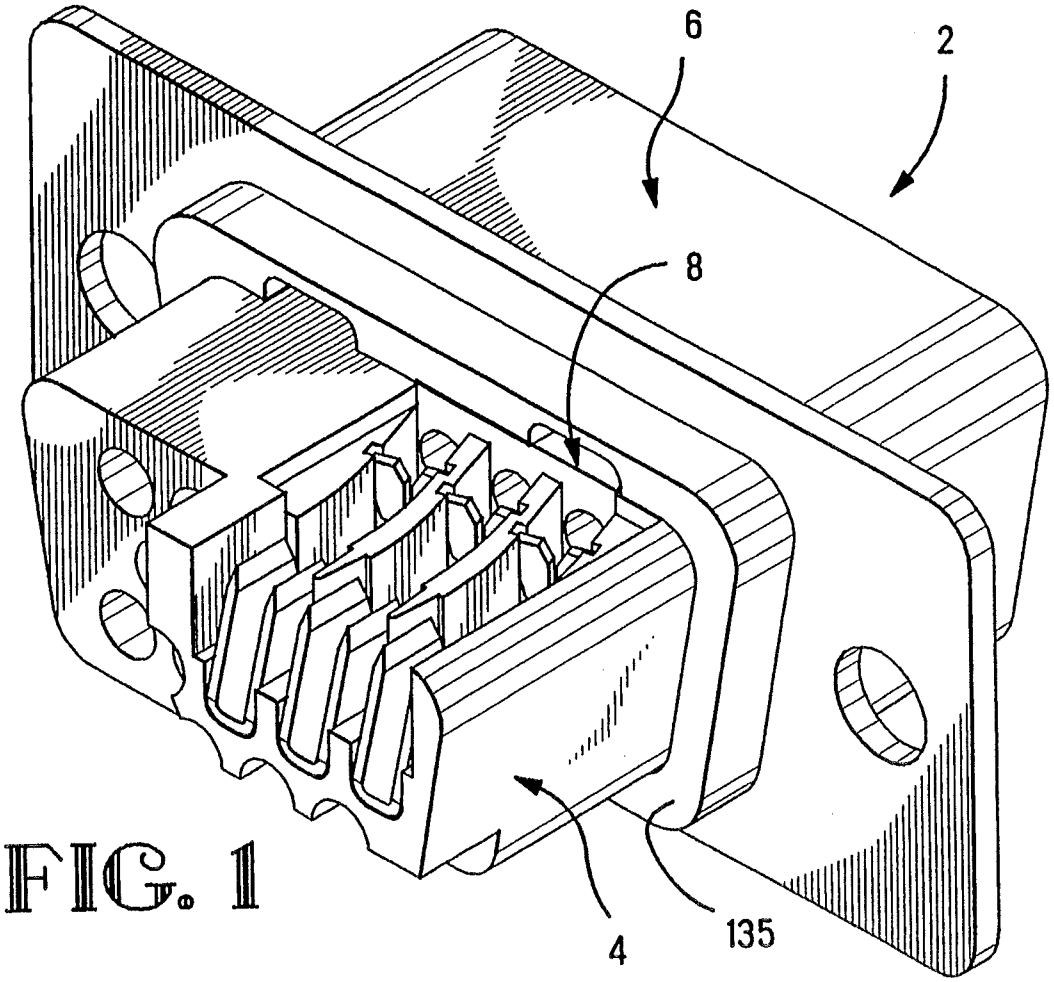
FIG. 1 is a rear isometric view of the connector assembly including the shield.

As shown in FIG. 1, the electrical connector of the present invention, which is shown as item 2, includes a rear housing portion 4, a front shield member 6 which forms an interface to a complementary connector, and an inner terminal retaining insert shown at 8.

As shown in FIGS. 2–5, the housing member 4 is shown as including a front flange 10 forming an internal peripheral surface 12, the peripheral surface 12 extending rearwardly to an inner wall from which extend terminal retaining pillar portions 16. These pillar portions are for retaining and positioning the standard terminal pin portions. However three pillar portions designated at 18 are for positioning three of the ground pins which are associated with the coaxial cable as will be described in greater detail.

Figure 3:
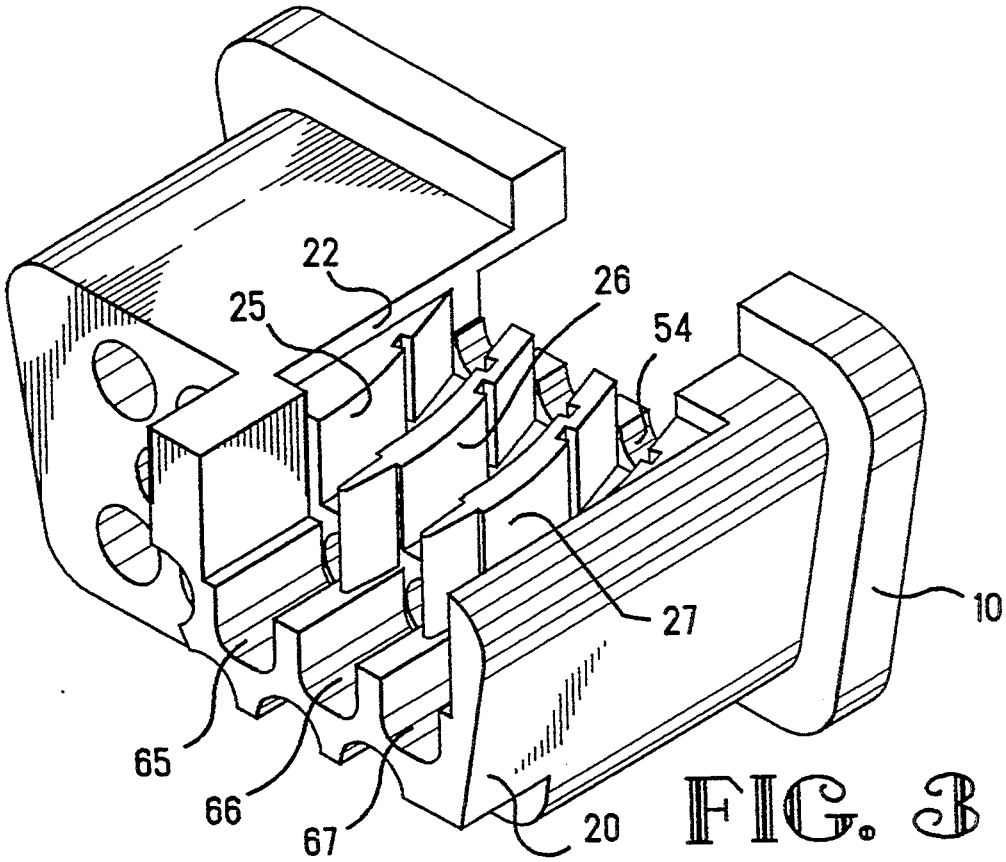
FIG. 3 is a rear isometric view of the housing of FIG. 2.

As shown best in FIG. 3, a rear extending ledge portion 20 is shown for terminating coaxial conductors and their respective ground pins. The ledge portion has an upper opening at 22 providing for access into the housing in a transverse direction for mounting the contacts. As the coaxial cable is wider than standard cable typically used in this type of connector, as shown in FIG. 4, the area for terminating the coaxial conductors is spread out over an enlarged distance, and then curved into position such that the spacing of the pins is the same as a standard connector, such as an AMPLIMITE HD-22 connector.

Figure 2:
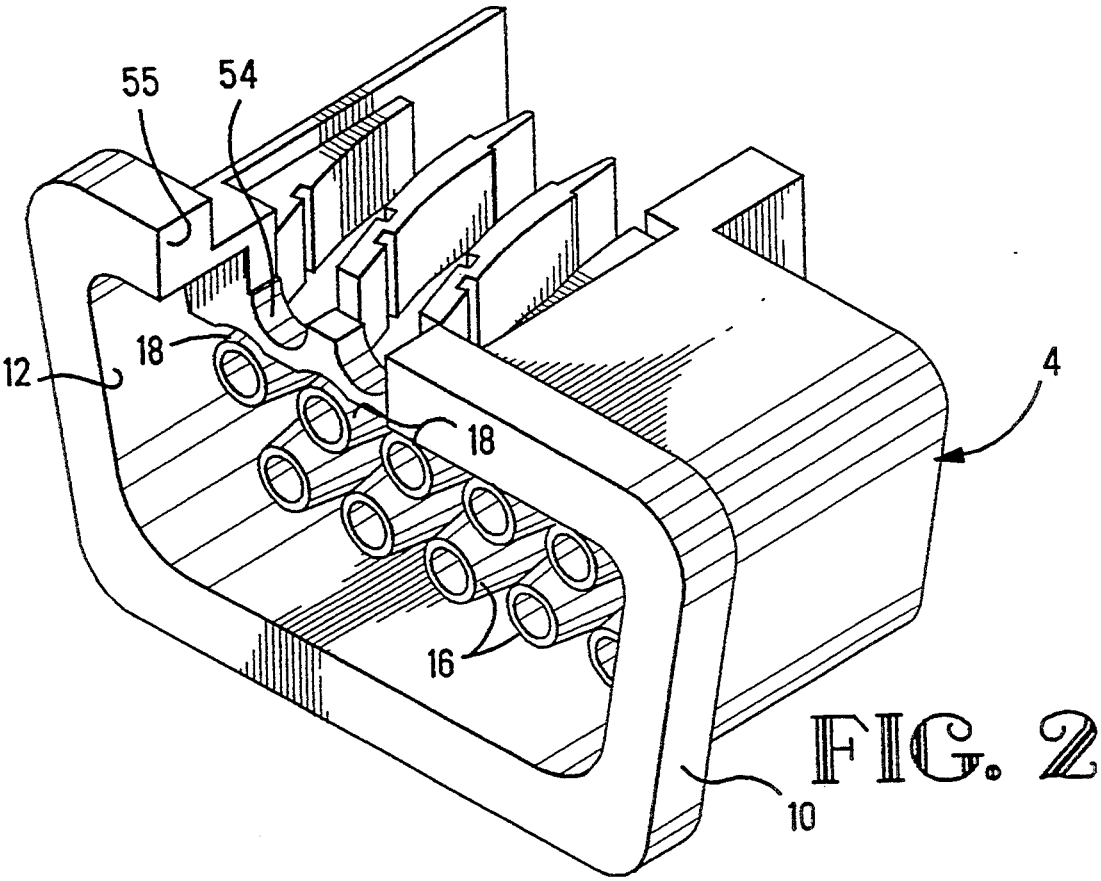
FIG. 2 is a front isometric view of the inner housing assembly.
Figure 4:
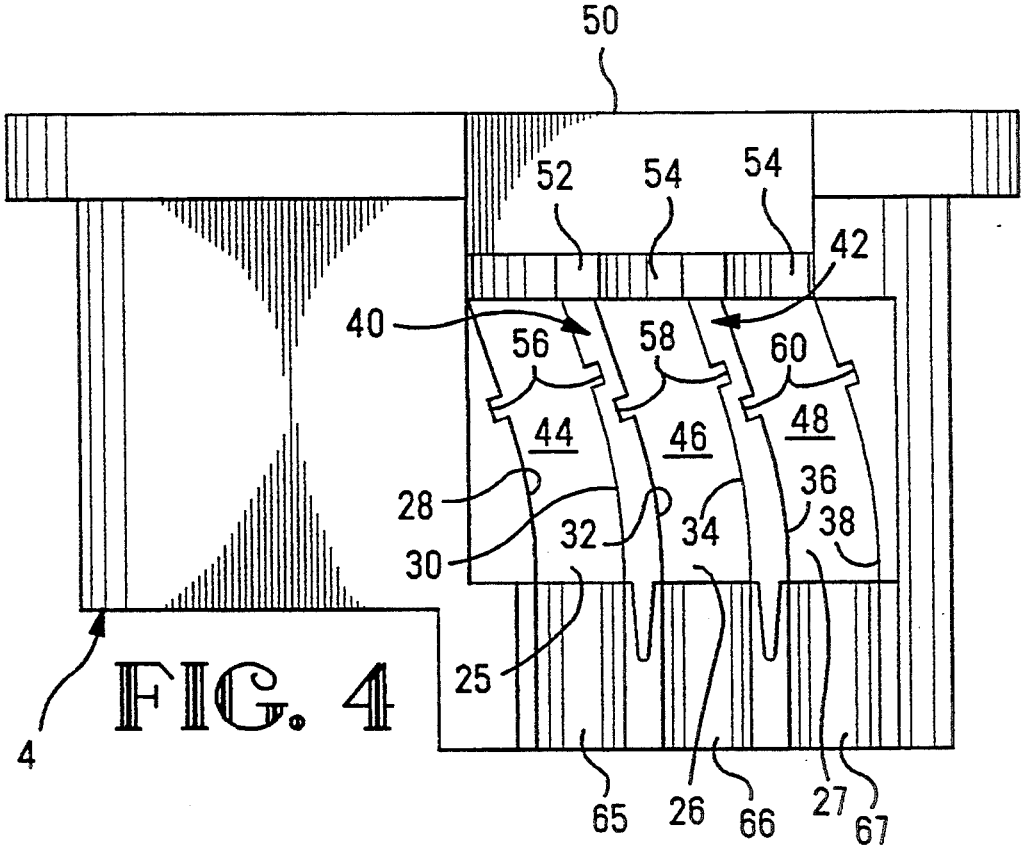
FIG. 4 is an upper plan view of the housing of FIG. 2.

As shown in FIG. 3, upper channels are formed at 25, 26 and 27, and as shown in FIG. 4, channel 25 is formed between surfaces 28 and 30, channel 26 is formed between surfaces 32 and 34 and channel 27 is formed between surfaces 36 and 38. It should be appreciated that the inner surfaces 30-36 are formed by upstanding wall portions at 40 and 42. The channels 25, 26 and 27 are further formed with lower support surfaces or floors, 44, 46 and 48 respectively. Each of the channels 25, 26 and 27 extend forwardly towards a front mating end 50 of the connector housing 4 and extend to a wall 52 as best shown in FIG. 4. The wall includes three semi-circular support surfaces 54 as shown in FIGS. 2 and 4. The inner surfaces 28 and 30 include opposed slots 56, the surfaces 32 and 34 include slots at 58 and the surfaces 36 and 38 include slots at 60.

Figure 5:
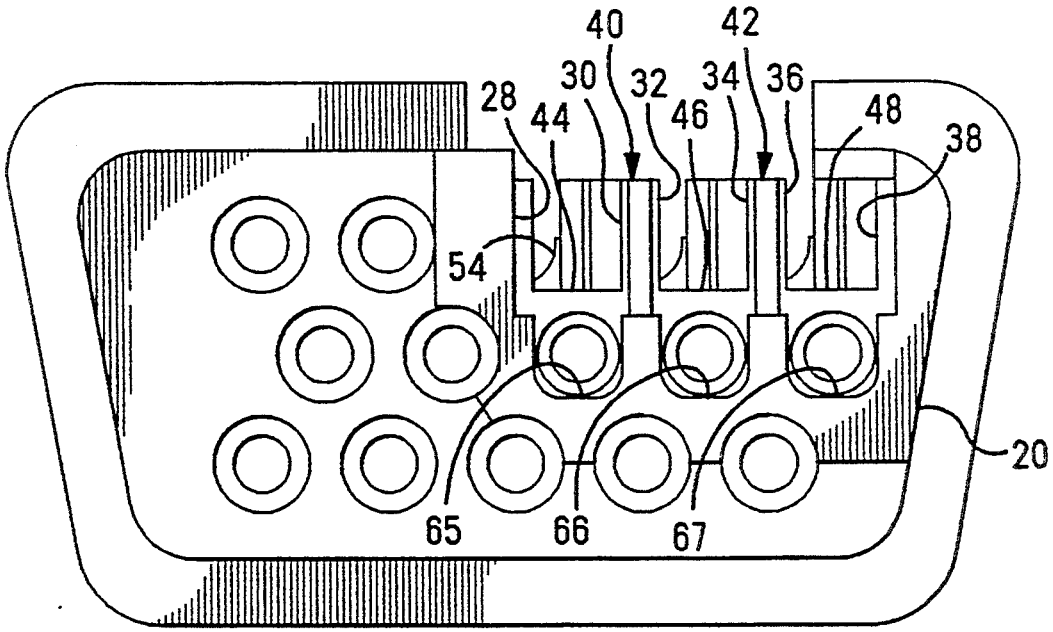
FIG. 5 is a rear plan view of the housing of FIGS. 2 and 4.

As best shown in FIGS. 3 and 5, three lower channel portions 65, 66 and 67 are axially aligned with channels 25, 26 an 27 respectively. As best shown in FIG. 5, channels 65, 66 and 67 extend forwardly into respective openings at 70 which extends through the pillar portions 18 as shown in FIG. 2.

Figure 6:
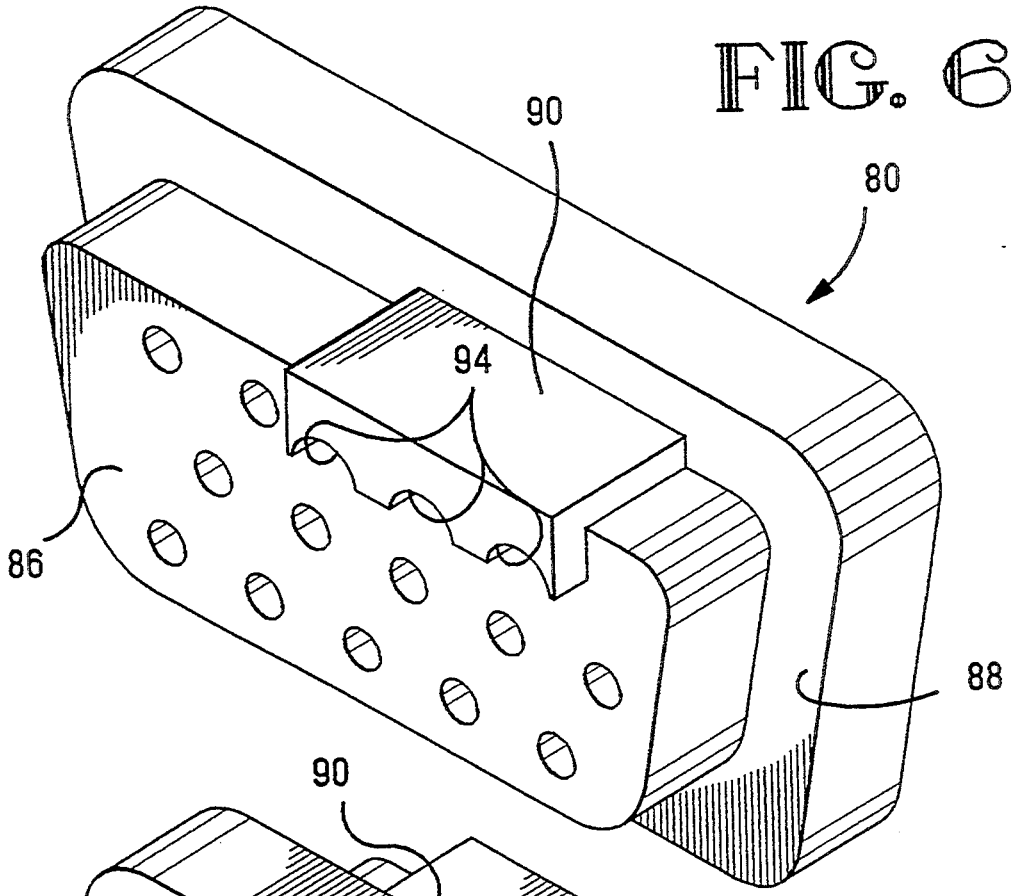
FIG. 6 is a rear isometric view of an insert for placing over the front face of the inner housing shown in FIG. 3.
Figure 7:
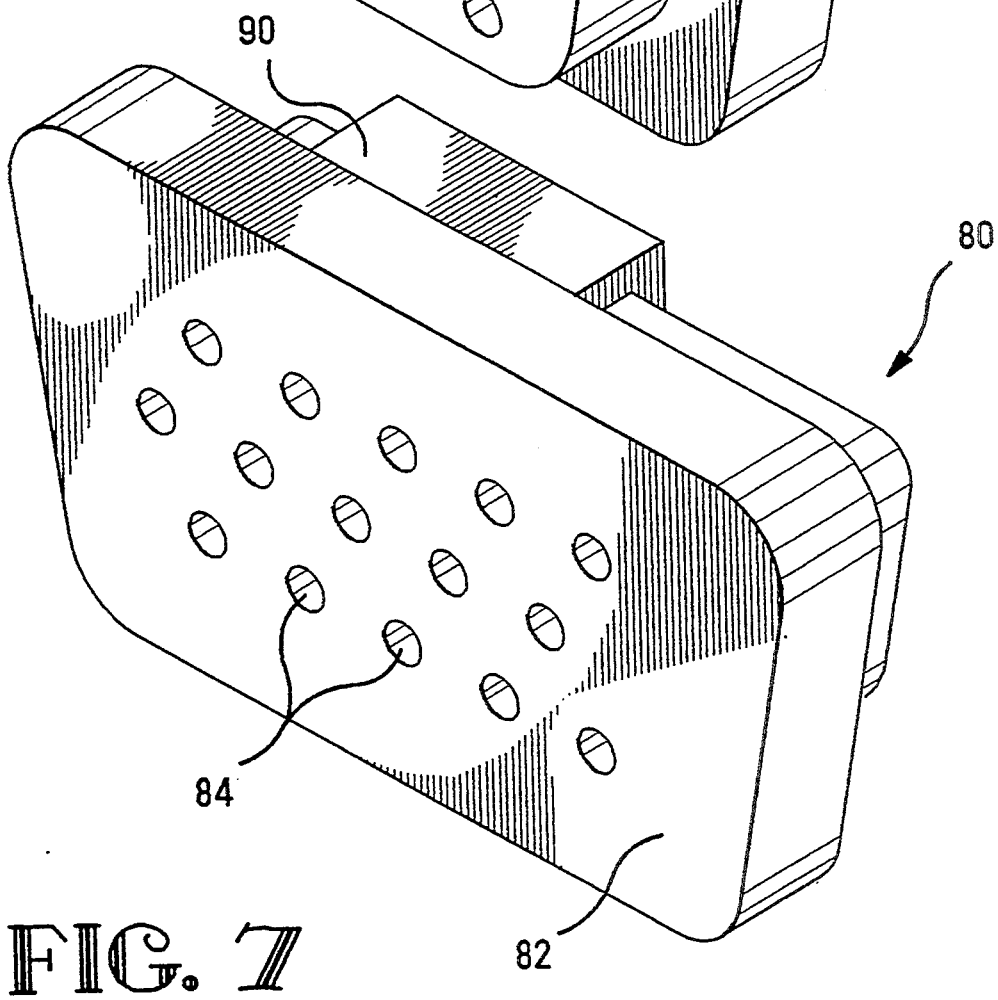
FIG. 7 is a front isometric view of the insert shown in FIG. 6.

With respect now to FIGS. 6 and 7 a terminal retaining insert is shown generally at 80 and includes a front plate portion 82 having a plurality of apertures at 84. It should be appreciated that each of the apertures 84 are aligned with the various pillar portions 16 and 18 and with the various semi-circular support surfaces 54.

As shown in FIG. 6, a rear plate portion 86 has a smaller periphery than the front plate portion 82 thereby forming a peripheral groove at 88 which is profiled to be received within the peripheral surface 12, which is shown in FIG. 2. A retaining member is also shown at 90 which extends beyond the rear portion 86 and includes three semi-circular portions 94 which are complementary with semi-circular portions 54 as will be described in greater detail herein.

Figures 8, 9, 10, 11, 12, 13, 14:
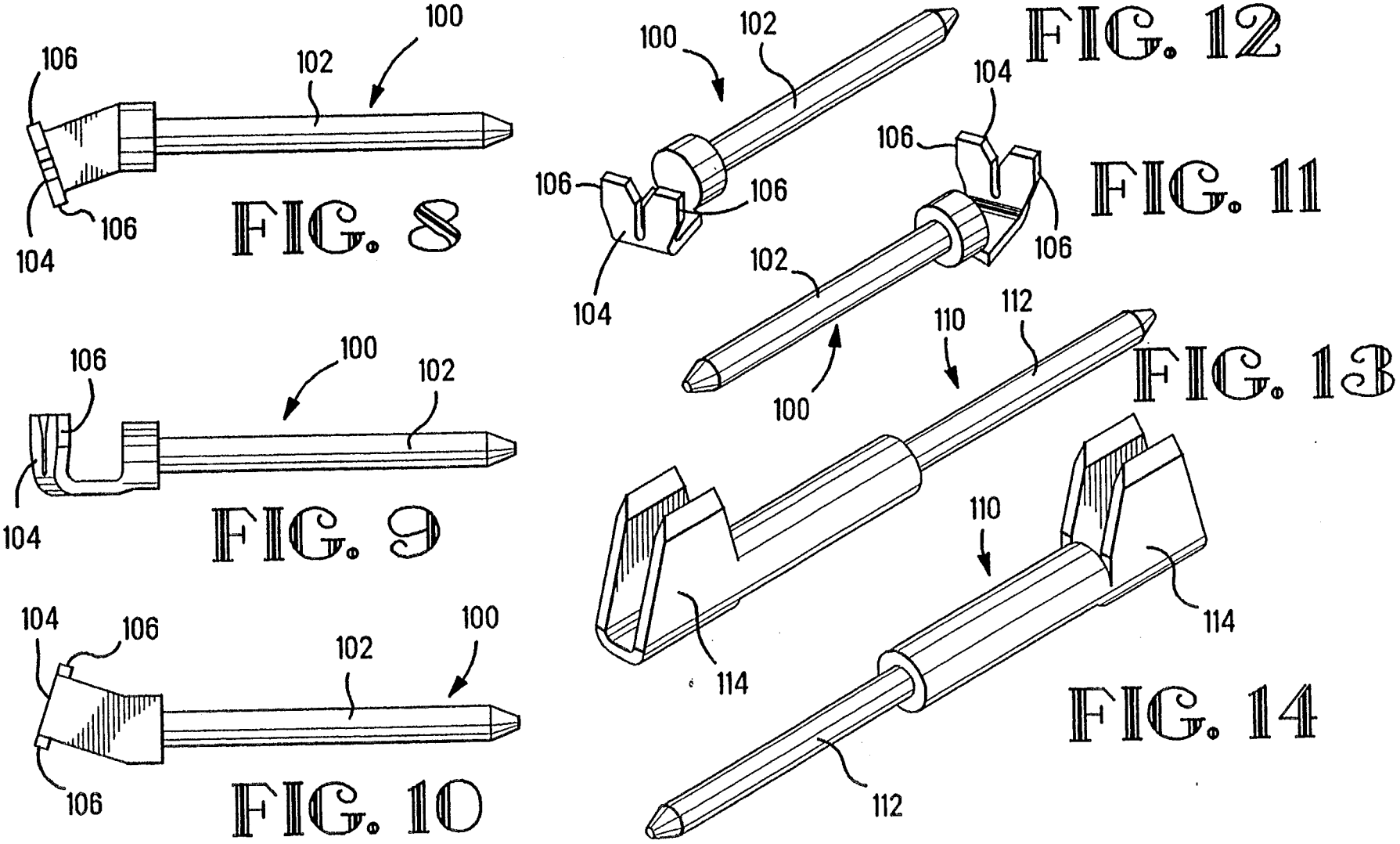
FIGS. 8–12 show various views of the signal contacts.
FIGS. 13 and 14 show isometric views of the ground contacts.

A plurality of terminals are also included, the signal pins being shown in FIGS. 8–12 whereas the ground pins are shown in FIGS. 13 and 14. As shown in FIG. 12, the signal pins 100 are comprised of a forward pin contact portion 102 and a rear wire insulation displacement slot section 104. As best shown in FIGS. 8 and 10, the pin portions are shown skewed relative to their respective insulation displacement slot portion, and thus it should be appreciated that the terminals 100 can be placed in respective passageways 25, 26 and 27 with side edges 106 of the slots 104 positioned within the respective slots 56, 58 and 60 with the circular support surfaces 108 being positioned on the semi-circular portions 54 within the housing 4.

A ground contact pin is shown in FIGS. 13 and 14 as item 110 and generally includes a forward contact pin portion 112 and a rear insulation severing portion 114. It should be appreciated that the portions 114 are relatively high and extend vertically upwardly from the center line of the pin portion 112.

Figure 15:
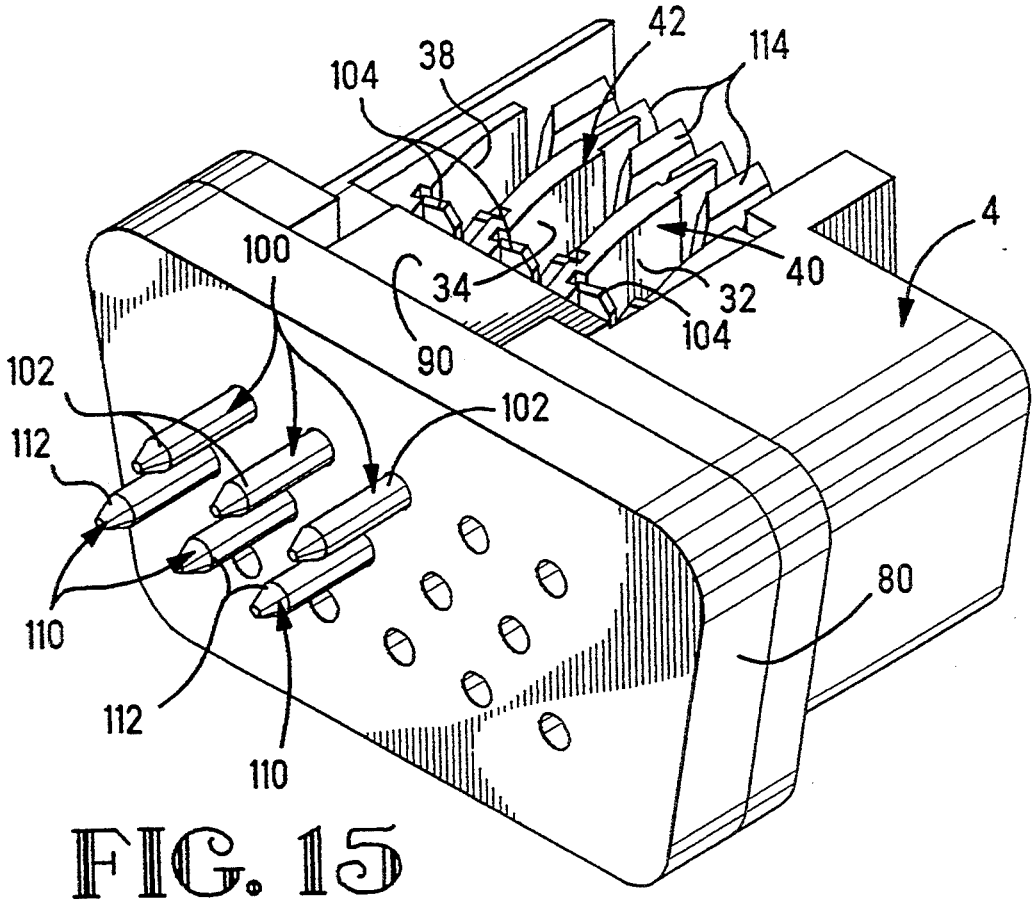
FIG. 15 shows a front isometric view of the connector housing including the front insert positioned in place.
Figure 16:
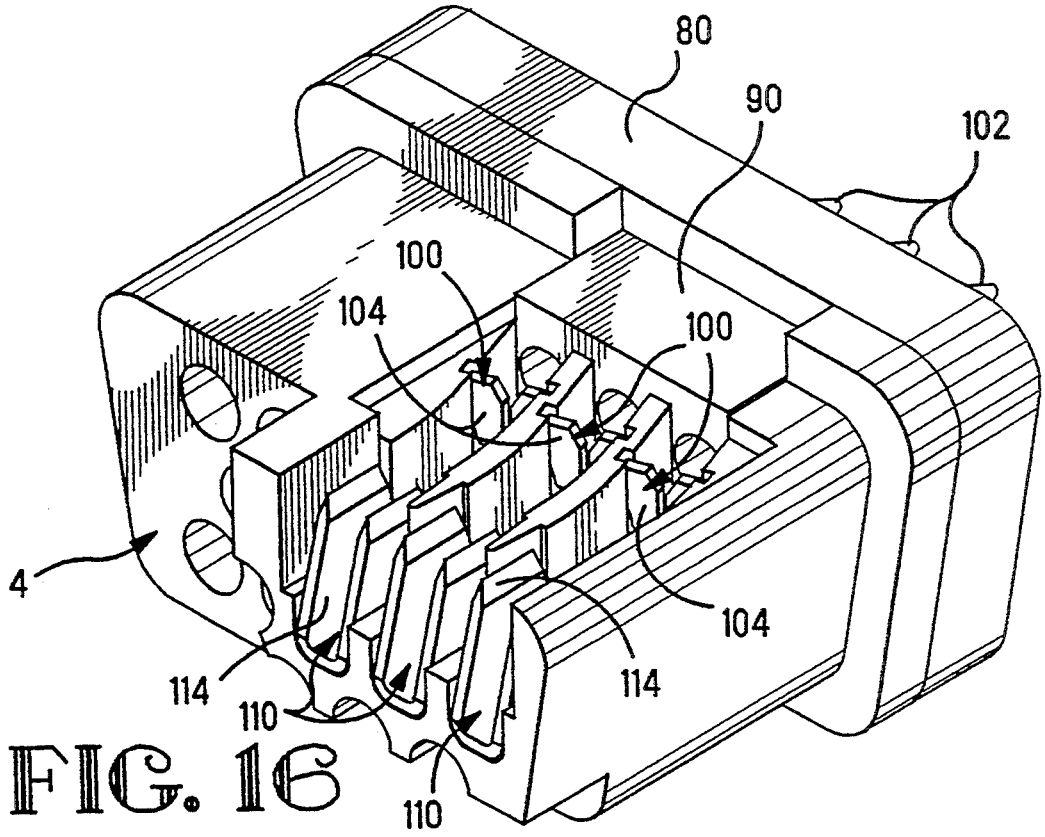
FIG. 16 is a rear isometric view of the assembly of FIG. 3.
Figure 17:
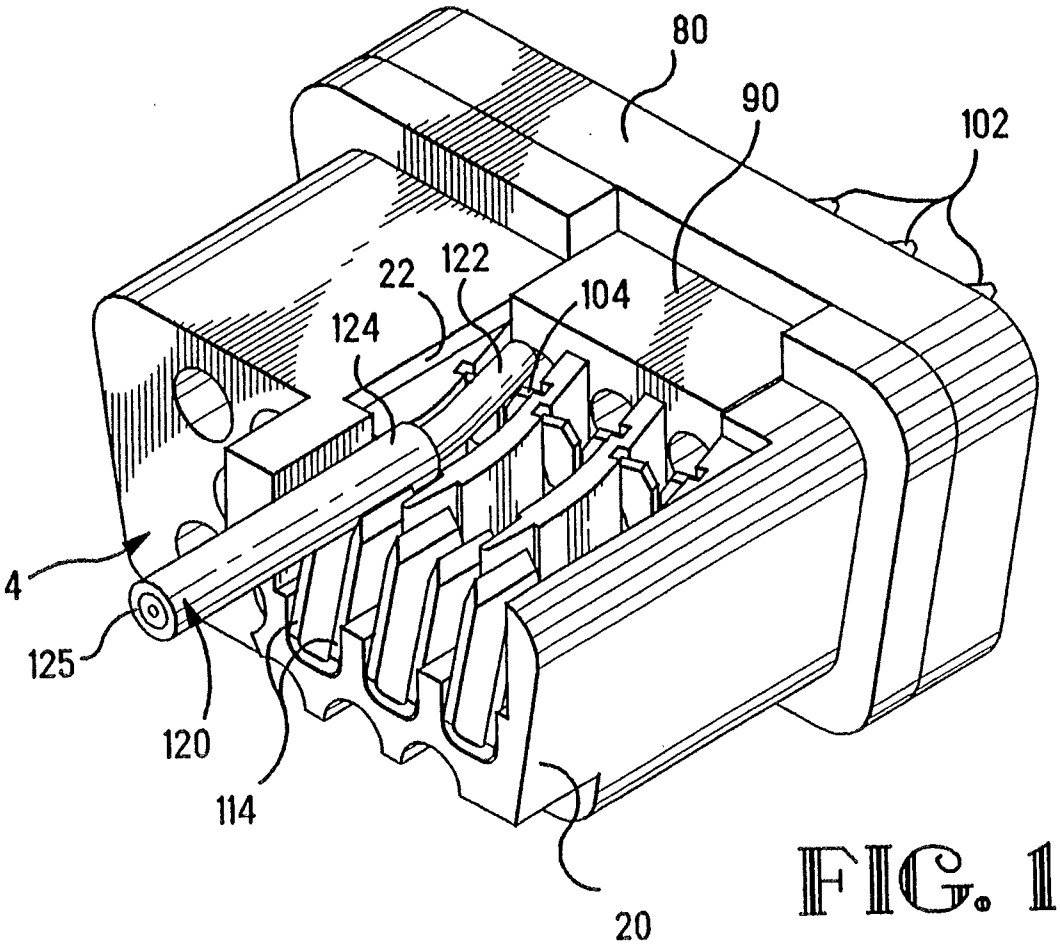
FIG. 17 is a view similar to that of FIG. 16 showing a coaxial cable positioned above the associated signal and ground contacts.

With respect now to FIGS. 16 and 17, the assembly of the connector will be shown in greater detail. As described above, the three terminals 100 are positioned in their respective passageways 25, 26 and 27 with the retaining member 80 snapped into position as shown in either of FIGS. 15 and 16. The ground pins 110 can also be positioned within their respective slots 65, 66 and 67 (FIG. 5) which positions the insulation severing plates 114 in alignment with the upper slot portion 25–27. To terminate the coaxial cable 120, the central insulated conductor 122 can be positioned adjacent to the insulation displacement slot portion 104 while the rear insulated cable 124 can be positioned above the plate portions 114. Upon termination of the cable 120 into the respective slots 25, 26, 27 the signal conductor 122 is terminated to one of the signal pins 102 whereas the shield 125 of the cable 120 is terminated to the pin portion 112 via the insulation severing members 114. Thus as shown in FIG. 15 at the front face of the connector, the signal pins 102 extend outwardly of the retaining plate 80 along the upper row, while the ground pins 112 extend through the retaining plate 90, through the middle row thereof.

Figure 18:
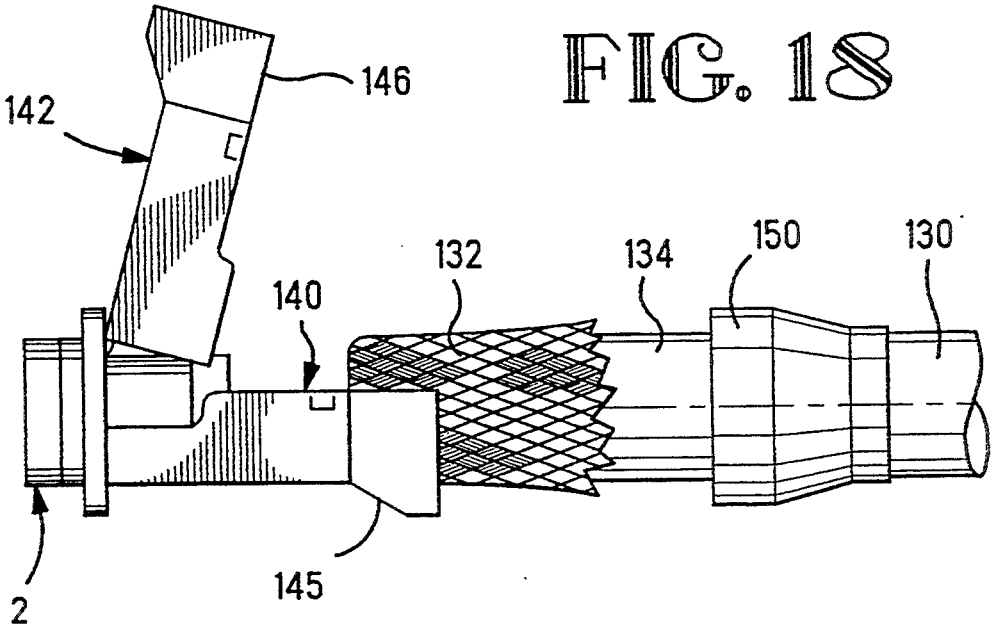
FIG. 18 shows the connector of FIG. 1, positioned within shield members.
Figure 19:
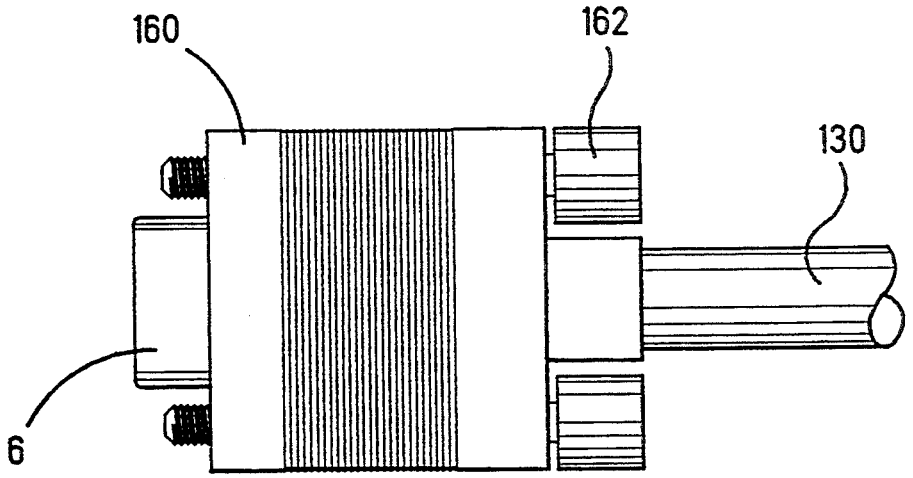
FIG. 19 shows the finished connector with an overmoulded insert over the entirety of the connector with the cable in place.

With respect now to FIG. 18 a shielded cable is shown at 130 having an inner shielding braid 132, the shielded cable 130 would include three coaxial cables 120 and nine signal conductors for terminating to standard pins and for placement in the apertures 15 (FIG. 5). The forward outer shield member 6 includes a rear wall portion 135 which can be folded over the flange portion 10 of the housing 4 thereby maintaining the housing 4 and the retainer plate 90 in position. A lower shield member 140 and an upper shield member 142 are placed around the connector member 2 as shown in FIG. 1 with the shield member 132 shown dressed over the outer insulation 134 and positioned in a rear section 145 of the lower shielding shell 140. The upper shielding shell 142 includes a complementary section at 146, such that when the upper shield member 142 is rotated into a latched position relative to the lower shield member 140 the entire connector member is shielded. A rear ferrule member 150 is then crimped over the shielding braid 132 maintaining the shielding braid 132 in constant ground contact with the shell members 140 and 142. In the preferred embodiment of the invention, a housing is overmoulded the assembly shown in FIG. 18 to include an insulative member shown at 160 with the connector shield portion 6 extending out the forward end thereof and the cable member 130 extending out the rearward end thereof. Thumb screws as shown at 162 would be used to retain the connector to a complementary electrical connector.

Figure 20:
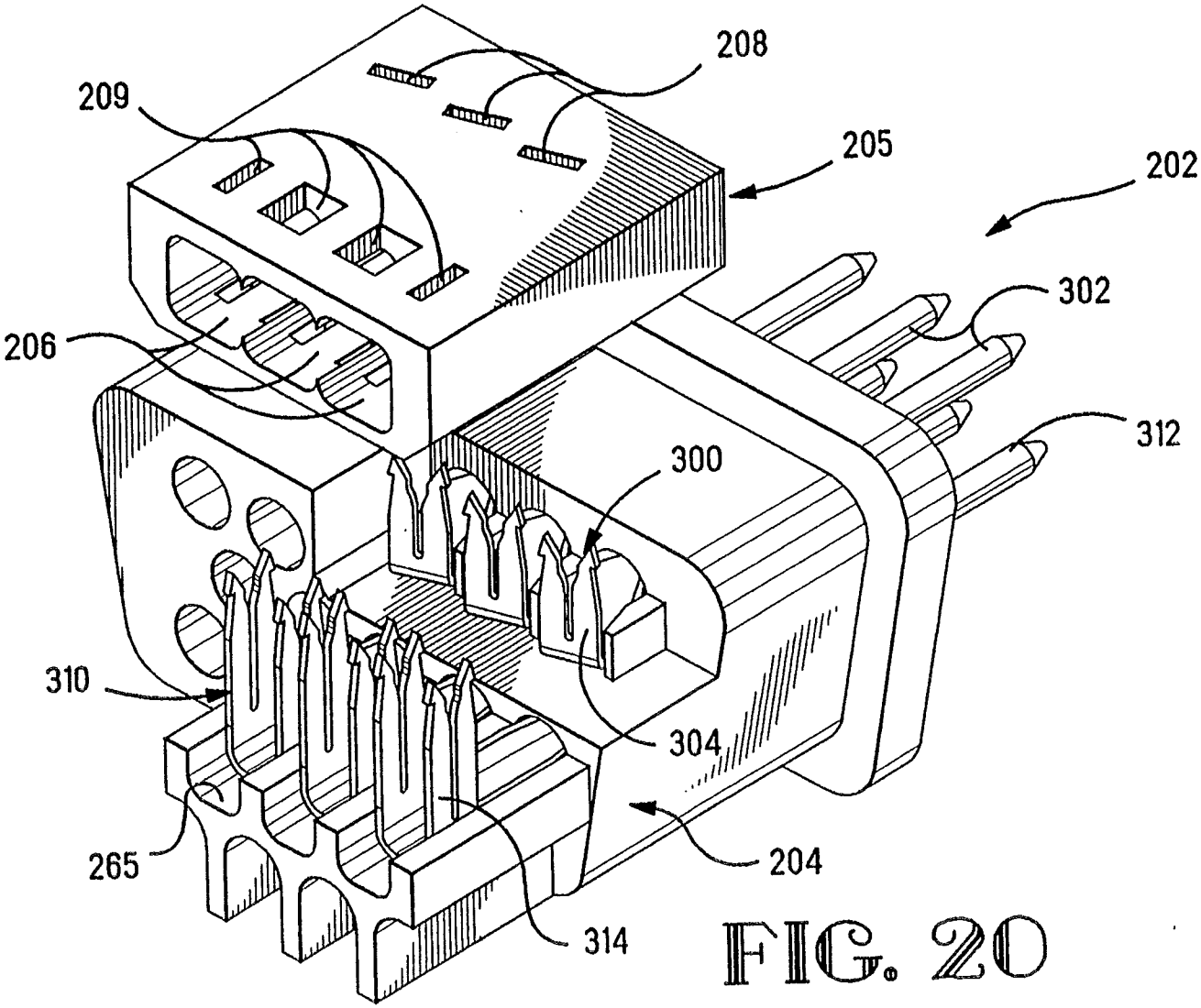
FIG. 20 is an alternate embodiment of the above described invention where the cable channels for the coaxial cable are provided in a separated stuffer cap.
Figure 21:
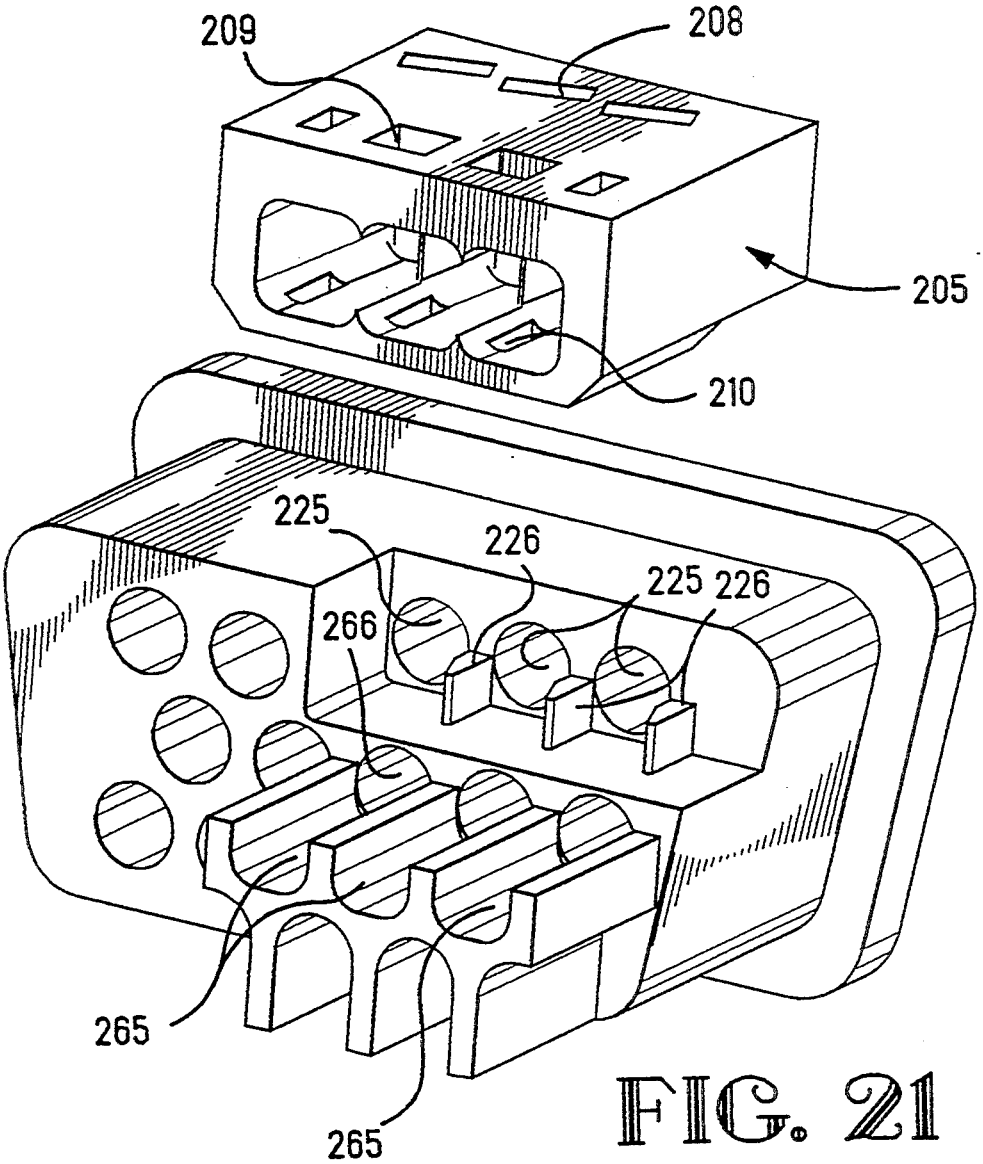
FIG. 21 is an exploded view of the connector shown in FIG. 20 without the terminals in place.

Alternatively the invention could be designed as shown in FIGS. 20–23 where the connector 202 is shown comprising a housing 204 and a separated stuffer cap 205. Similarly signal contacts 300 are positioned in apertures 225 with spacer walls 226 positioned therebetween to guide and support the electrical terminals 300, as shown in FIGS. 20 and 21. Also similarly, ground contacts 310 are positioned in channels 265 which are in communication with apertures 266 to allow the pins 312 of the ground contacts 310 to project through the front thereof as shown in FIG. 20. The insulation severing is accomplished by slotted plate members 314 having upper cutting edges.

Figure 22:
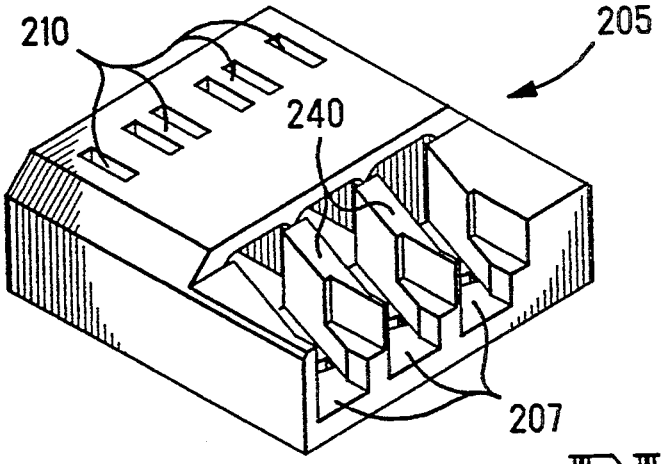
FIG. 22 is an isometric view of the stuffer cap shown in FIGS. 20 and 21 as shown from underneath.
Figure 28:
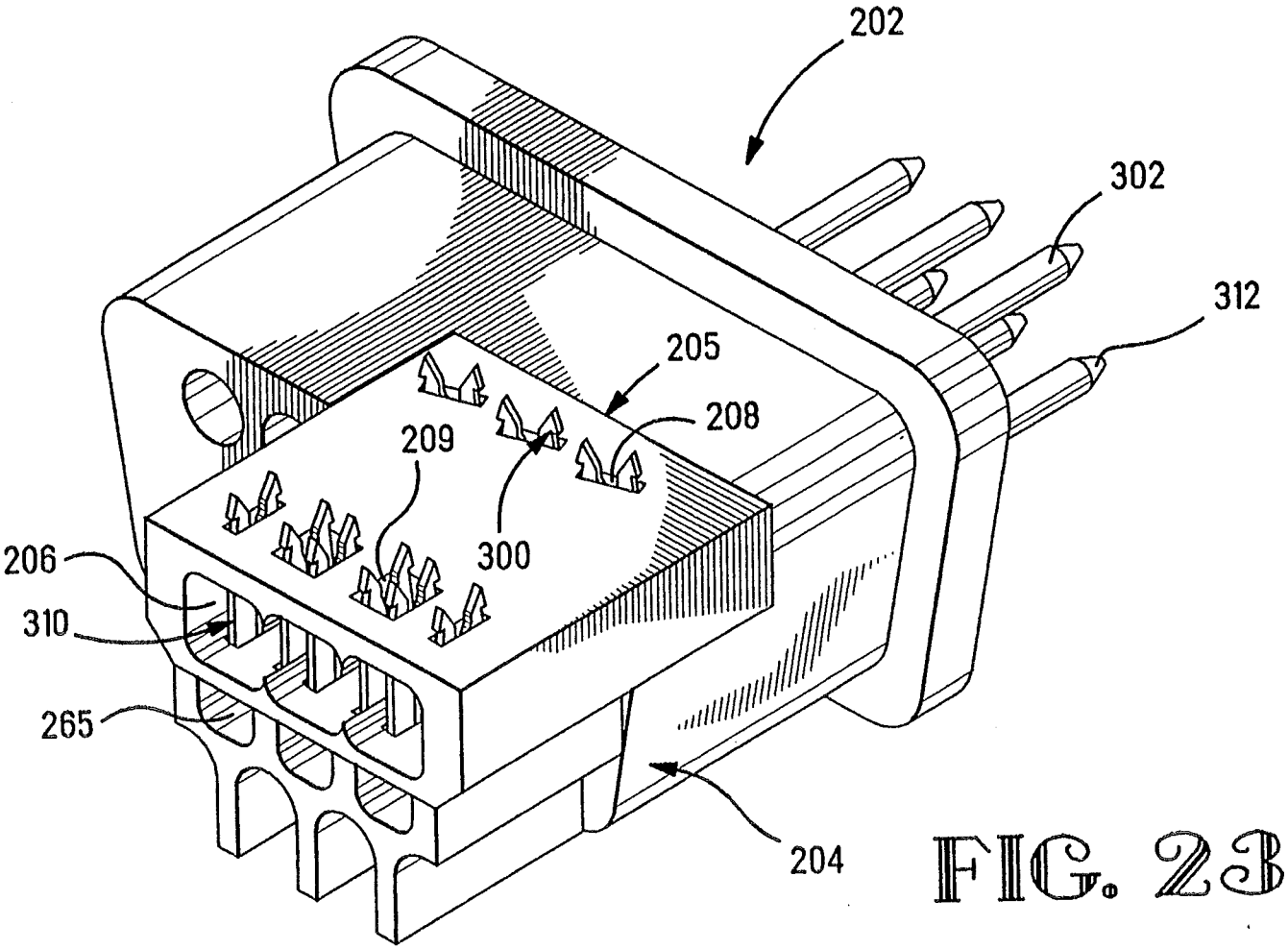

As shown in FIG. 22, walls 240, of the stuffer cap 205, are provided which serve the same function as walls 40 and 42 as shown in FIG. 4, that is to align the wires into a curved or arcuate path. Openings 206 of the stuffer cap allow the entry of the coaxial cables into the channels 207 defined by the walls 240. Slots 208 on the top side of the stuffer cap allow the entry of the IDC portion of the terminal 300 as shown in FIG. 23 whereas apertures 209 allow the entry of the IDC portions of terminals 310 as also shown in FIG. 23. Apertures 210 on the lower side of the stuffer cap 205 as shown in FIGS. 21 and 22 allow the passage of the upstanding terminal portions 314 to extend upwardly through the stuffer cap for termination thereof.

We claim:

1. An electrical connector for the electrical connection to a coaxial cable, the connector comprising a housing, a signal contact for electrical connection to a coaxial signal conductor of the coaxial cable, and a shielding contact for electrical connection to a shield conductor of the coaxial cable, the connector being characterized in that the housing includes a channel to arrange the coaxial cable in an arcuate path, and the shielding contact includes insulation piercing means extending in a plane substantially parallel to a longitudinal axis of the cable, and profiled to pierce through the insulation of the coaxial cable to make contact with the shielding conductor.

2. An electrical connector according to claim 1, characterized in that said signal conductor includes a terminating portion for making electrical connection with the signal conductor of the coaxial cable.

3. An electrical connector according to claim 1, characterized in that said signal terminating portion is an insulation displacement contact.

4. An electrical connector according to claim 1, characterized in that said signal and ground contacts are arranged in parallel rows, with the signal contacts arranged above the ground contacts.

5. An electrical connector according to claim 1, characterized in that the ground terminating portions upstand to a vertical position where the signal and ground terminating portions are in the same longitudinal plane, whereby a coaxial cable can be mass terminated to the signal and ground contacts.

6. An electrical connector according to claim 1, characterized in that said connector includes a stuffer body for holding said coaxial cable during said termination.

7. An electrical connector according to claim 1, characterized in that the terminating portion of the shielding contact includes parallel plates spaced apart at a distance substantially equal to the diameter of said shielding braid.

8. An electrical connector according to claim 7, characterized in that said plates include insulation piercing prongs to pierce through said insulation.

9. An electrical connector according to claim 8, characterized in that said insulation piercing prongs are slotted at least partially along their length.

10. An electrical connector for the electrical connection to signal and ground conductors of coaxial cables, the connector comprising a housing, signal contacts for electrical connection to the signal conductors, the signal contacts having contact portions and termination portions, ground contacts for electrical connection to the ground conductors of the coaxial cables, the ground contacts having contact portions and termination portions, the connector being characterized in that the signal termination portions having angled connection sections, and the ground contact portions are laterally offset from the signal contact portions, and the housing includes channels to arrange the coaxial cable in an arcuate path for connection to the signal termination portions and the ground termination portions.

11. The electrical connector of claim 1 characterized in that the channels are defined by upstanding intermediate walls provided on a rear platform of the electrical connector.

12. The electrical connector of claim 10, characterized in that the channels are provided in an integral separable stuffer cap having rear apertures for receiving the coaxial cable, and positioning the cable in juxtaposition with the termination sections of the signal and ground contacts.

13. An electrical connector for the mass termination of coaxial cables, the connector comprising:

an insulating housing comprising a front mating face, a wire terminating section, and arcuate shaped channels extending therebetween, the wire terminating section comprising a first terminal receiving platform, and a second terminal receiving platform positioned rearward of, and lower than, said first terminal receiving platform, a signal contact positioned on said first terminal receiving platform and having an angled insulation displacement contact portion disposed towards a rear section of said first platform, and a mating contact section positioned adjacent to the mating face; and a ground contact positioned on said second terminal receiving platform, having an insulation piercing contact portion disposed rearwardly of said signal insulation displacement contact portion, yet extending upwardly to a position above a plane formed by said first platform;

whereby a coaxial cable can be mass terminated to the two contacts, the signal conductor being interconnected to the signal contact, and a coaxial shield being terminated to the ground contact.

14. The connector of claim 13, wherein the insulation piercing contact portion of said ground contact extend in a plane substantially parallel to a longitudinal axis of the cable.

15. The connector of claim 14, wherein the insulation piercing contact portion are formed by slotted plates.

16. An electrical connector for the electrical connection to a coaxial cable having an inner conductor and an outer conductor, the connector comprising:

a housing having an arcuate shaped channel for receiving the coaxial cable therein;

a first contact disposed in said housing and having a first contact portion and an angled first termination portion for electrical connection to the inner conductor; and a second contact disposed in said housing and having a second contact portion and a second termination portion for electrical connection to the outer conductor, the second contact portion being laterally offset from the first contact portion;

whereby electrical connection between the coaxial cable and said first contact and between the coaxial cable and said second contact occurs along said arcuate shaped channel.

17. The connector of claim 16, wherein said second contact portion is laterally offset from the first contact portion.

18. The connector of claim 17, wherein said first contact termination portion is angled relative to the direction of the contact portion.

19. The connector of claim 18, wherein said second termination portion extends upwardly to be in alignment along said arcuate path with said first termination portion.

* * * * *